United States Patent [19]

Blue et al.

[11] 3,931,916

[45] Jan. 13, 1976

[54] DISPENSING-TYPE BOX

[75] Inventors: Maurice R. Blue, South Bend; Glen Younker, Dyer, both of Ind.

[73] Assignee: Slip-Not Corporation, Dyer, Ind.

[22] Filed: Aug. 15, 1974

[21] Appl. No.: 497,825

[52] U.S. Cl. ..... 222/465; 222/485; 222/565; 229/7 R; 229/52 A

[51] Int. Cl.[2] ..... B65D 5/46

[58] Field of Search ..... 222/465, 485, 556, 480, 222/565; 229/17 B, 17 R, 52 A, 7 R, 44 R, 52 AL

[56] References Cited

UNITED STATES PATENTS

| | | | |
|---|---|---|---|
| 3,053,432 | 9/1962 | Arneson | 229/52 A |
| 3,228,573 | 1/1966 | Nerenberg et al. | 222/485 |
| 3,239,110 | 3/1966 | Buter | 222/465 |
| 3,373,917 | 3/1968 | Cox | 229/52 A X |
| 3,707,806 | 1/1973 | Toews et al. | 229/52 A X |

FOREIGN PATENTS OR APPLICATIONS

| | | | |
|---|---|---|---|
| 1,361,451 | 4/1964 | France | 229/52 A |
| 670,668 | 9/1963 | Canada | 229/17 R |
| 925,975 | 5/1963 | United Kingdom | 229/17 R |
| 944,855 | 12/1962 | United Kingdom | 229/17 R |

*Primary Examiner*—Allen N. Knowles
*Assistant Examiner*—Charles A. Marmor
*Attorney, Agent, or Firm*—Woodhams, Blanchard and Flynn

[57] ABSTRACT

A dispensing-type box having therein a substantially closed compartment adapted for the storage of a particulate material. The box has dispensing openings formed in one sidewall of the box adjacent the upper end thereof, which openings are normally closed by a flap which is integrally formed on the box and extends downwardly over the openings. The flap has a striplike portion thereof secured to the box at a location below the openings, with the lowermost portion of the flap being free of connection to the box to permit same to be readily gripped so that the flap can be released from the box and swung upwardly to uncover the openings. The box also has, on the side thereof opposite the openings, a handle structure which comprises a separate member disposed within the interior of the box and projecting outwardly through an elongated slot formed in the sidewall of the box. The handle structure comprises a loop-like handle which can be folded downwardly to overlie the sidewall of the box.

1 Claim, 6 Drawing Figures

DISPENSING-TYPE BOX

FIELD OF THE INVENTION

This invention relates to an improved dispensing-type box having a simple but compact dispensing and handle structure associated therewith.

BACKGROUND OF THE INVENTION

While numerous dispensing-type boxes have been devised for storing and dispensing particulate materials, many of these known boxes have utilized a dispensing structure having a flap which is a portion of the box and must be perforated from the box in order to form an opening. This type of structure has proven undesirable since the perforation of the flap so as to form the opening often results in tearing or damage to the box. Other known dispensing-type boxes have utilized a flap covering a preformed opening, which flap is secured to the box throughout the complete edge thereof. This structure has also proved undesirable since the flap can be released from the box only with some difficulty, and this difficulty often results in undesired tearing of either the flap or the box.

Another disadvantage of most known dispensing-type boxes is their inability to be manufactured in large sizes so as to be capable of holding a substantial quantity of material, specifically a heavy material. While some boxes have been provided with handle structures associated therewith, nevertheless most of these known handle structures have been extremely complex so that they accordingly result in the overall manufacturing time and cost of the box being substantially increased, or in the alternative they have been extremely flimsy so that they are subject to tearing or breakage. Further, many of the known handle structures have been rigid and have not permitted the compact shipping and storage of a large plurality of similar boxes.

Accordingly, it is an object of the present invention to provide an improved dispensing-type box which overcomes the above-mentioned disadvantages. Particularly, the dispensing-type box of the present invention provides, in combination, an improved dispensing and handle structure associated integrally with the box to permit the efficient pouring of particular material from the box.

It is also an object of the present invention to provide a dispensing-type box, as aforesaid, which is particularly adaptable for manufacturing in large sizes to permit storage therein of a substantial quantity of a particular material, which box can be efficiently and safely handled to permit dispensing of material therefrom without fear of breakage or tearing of the box.

A further object of the present invention is to provide a dispensing-type box, as aforesaid, which is extremely economical to both manufacture and assemble, which when in a closed condition is of a block-like configuration to facilitate the compact shipping and storage of same and of a large plurality of similar boxes, and which can be easily and efficiently opened and utilized for dispensing material without causing damage to either the dispensing or handle structures.

Other objects and purposes of the present invention, and the advantages thereof, will be apparent to persons familiar with structures of this type upon reading the following specification and inspecting the accompanying drawings.

Figure 1:
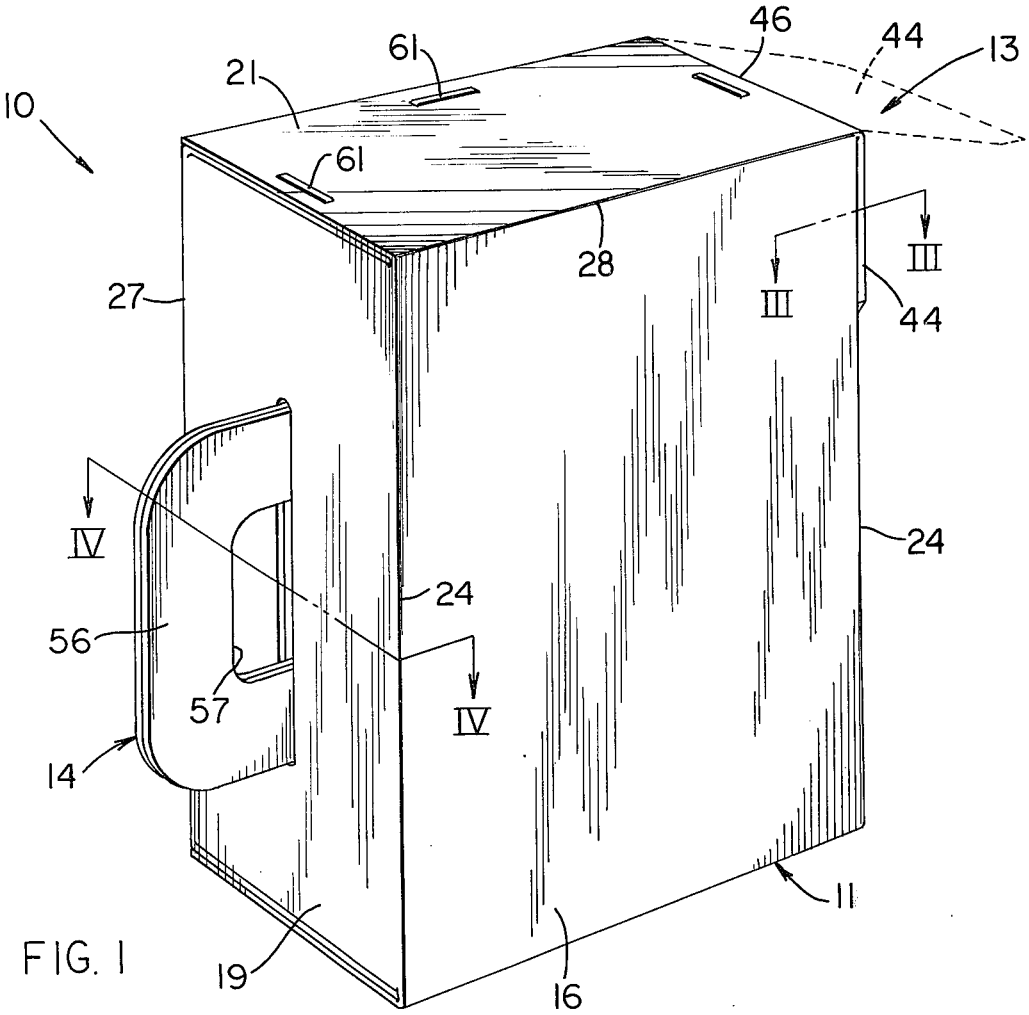
FIG. 1 is a perspective view of an improved dispensing-type box constructed according to the present invention.

Certain terminology will be used in the following description for convenience in reference only and will not be limiting. For example, the words "upwardly", "downwardly", "rightwardly" and "leftwardly" will refer to directions in the drawings to which reference is made. The words "front" and "rear" will refer to the right and left side, respectively, of the box as appearing in FIG. 1. The words "inwardly" and "outwardly" will refer to directions toward and away from, respectively, the geometric center of the structure and designated parts thereof. Said terminology will include the words above specifically mentioned, derivatives thereof and words of similar import.

SUMMARY OF THE INVENTION

The objects and purposes of the present invention are met by providing a substantially closed box defining therein a compartment adapted for storing a particulate material. The box has a plurality of openings formed in one of the sidewalls adjacent the upper end thereof, and a flap is integrally formed on the top wall of the box and projects downwardly over the sidewall so as to cover said openings. The flap is securely connected to the sidewall along a strip which is disposed directly under the openings. The lowermost edge of the flap is not fixed to the sidewall so that the flap can be readily gripped to permit same to be swung upwardly to uncover the openings. The box also has a handle structure associated with the sidewall thereof which is disposed opposite the sidewall having the openings therein. The handle structure is formed from a separate blank which is suitably folded and disposed within the interior of the box and has a loop-like handle which projects outwardly through a slot formed in the sidewall. The handle can be folded to overlie the sidewall to permit compact shipping and storing of the box. The handle also permits the box to be gripped in one hand and tipped to permit dispensing of the particulate material through the openings.

DETAILED DESCRIPTION

FIG. 1 illustrates therein a dispensing-type receptacle 10 constructed according to the present invention. Receptacle 10 includes a box 11 defining therein a compartment 12 adapted for the storage of a particulate material, particularly a granular material. The box 11 has a dispensing means 13 associated therewith for permitting the particulate material to be dispensed. A handle means 14 is also associated with the box to facilitate both the handling of the box and the dispensing of the material.

The box 11 comprises a conventional six-sided prism having all of the adjacent walls disposed substantially perpendicular to one another. The box 11 specifically includes opposed and substantially parallel sidewalls 16 and 17, which sidewalls are joined by opposed and substantially parallel front and rear walls 18 and 19, respectively. The box 11 is closed by opposed and parallel top and bottom walls 21 and 22, respectively.

Figure 5:
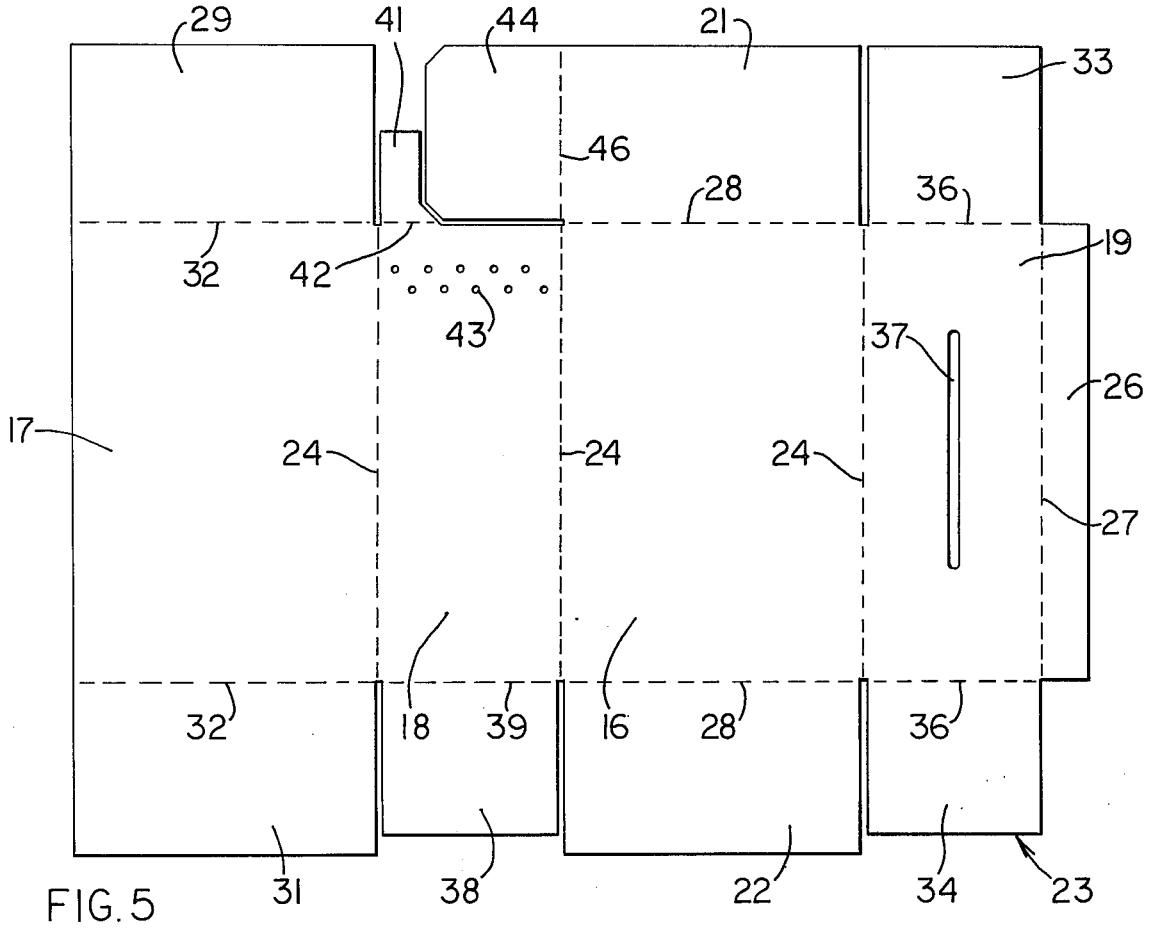
FIG. 5 is a plan view of the punched blank used for forming the box, the blank being illustrated with the inside surface facing upwardly.

Box 11 is preferably formed from a single sheet of material, such as by being punched from a sheet of conventional corrugated cardboard. FIG. 5 illustrates therein a punched planer blank 23 which is used for forming the box 11.

Figure 4:
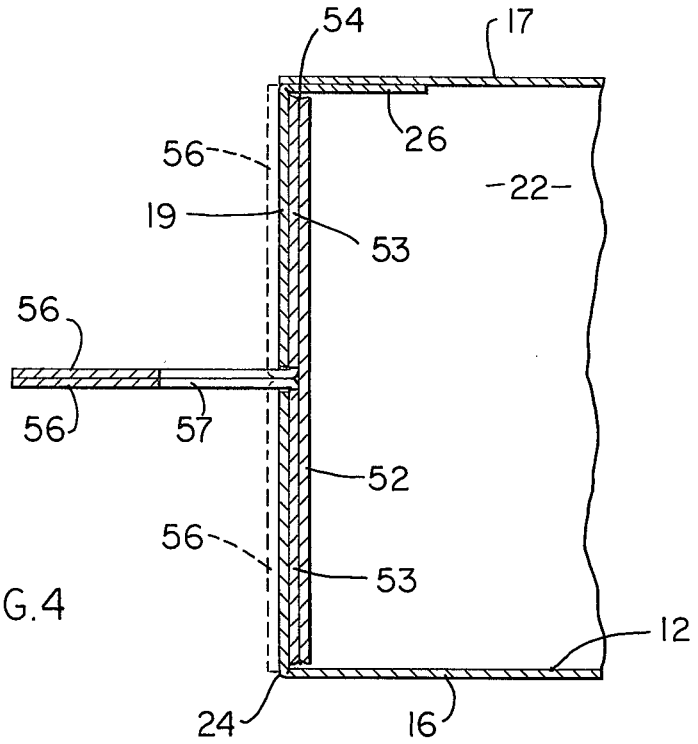
FIG. 4 is a further fragmentary sectional view taken along the line IV—IV in FIG. 1.
Figure 3:
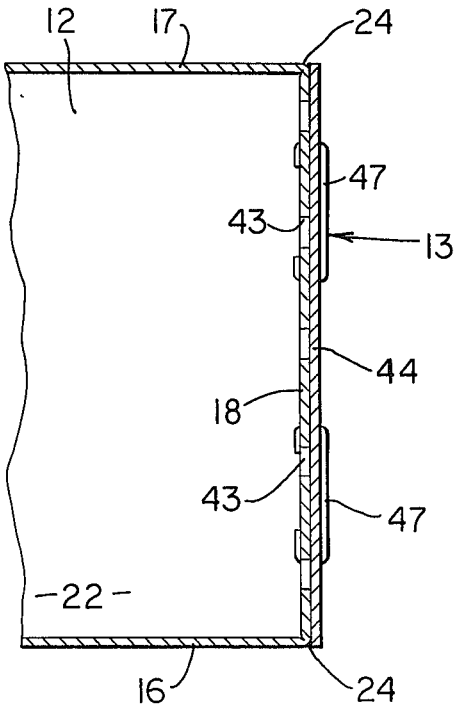
FIG. 3 is a fragmentary sectional view taken along the line III—III in FIG. 1.

The blank 23 includes four integrally connected rectangular portions which define the sidewalls 16 and 17 and the front and rear walls 18 and 19, respectively. These walls are appropriately separated by means of fold lines 24, which lines have been indicated by dotted lines in FIG. 5. The rear wall 19 also has a rectangular tab 26 connected thereon and separated therefrom by a further fold line 27. The tab 26 is adapted to overlie and be fixedly secured, as by an adhesive, to the inner surface of the sidewall 17 (as illustrated in FIG. 4) when the blank 23 is formed into a rectangular tubular configuration.

The sidewall 16 of the blank 23, as illustrated in FIG. 5, has a pair of rectangular flaps integrally fixed to and projecting outwardly from the opposite ends thereof, which flaps define the top and bottom walls 21 and 22, respectively, and are swingable relative to the sidewall 16 about the fold lines 28. A further pair of substantially rectangular flaps 29 and 31 are fixedly and integrally connected to the upper and lower edges of the sidewall 17, which flaps are also hingeably swingable relative to the sidewall about the fold lines 32.

Blank 23 includes still a further pair of rectangular flaps 33 and 34 integrally connected to the upper and lower edges of the rearwall 19, which flaps are separated from the rear wall by fold lines 36. Front wall 18 also has a rectangular flap 38 integrally connected to the lower edge thereof, same being separated by the fold line 39, and a small flap 41 is connected to the upper edge of the front wall 18, which flap 41 is separated from the front wall by a fold line 42.

As illustrated in FIG. 5, rear wall 19 also has an elongated slot 37 formed therein for a purpose to be explained hereinafter.

Figure 2:
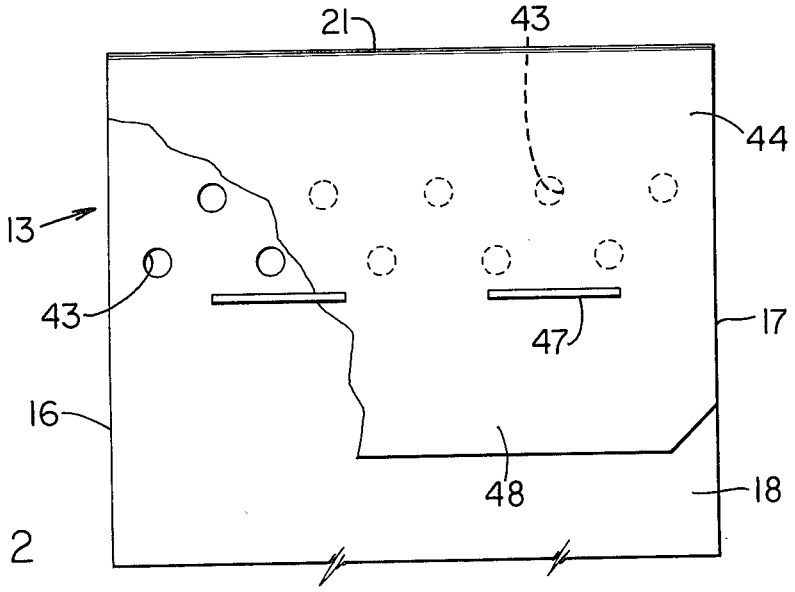
FIG. 2 is a broken side elevational view which illustrates the dispensing structure associated with the front side of the box.

Considering now the dispensing means 13, same includes a plurality of openings 43 formed in the front wall 18 adjacent the upper end thereof. The openings 43 are, in the illustrated embodiment, of circular configuration and are disposed within two substantially horizontally extending rows which are spaced one above the other. To cover the openings 43, the top wall 21 is provided with a further substantially rectangular flap 44 integrally connected thereto, which flap 44 is secured to one of the side edges of the wall 21 and is separated therefrom by the fold line 46. The flap 44, when the box is assembled, is folded downwardly so as to overlie the front wall 18 as illustrated in FIGS. 1 and 2. The flap 44 is suitably secured to the front wall 18, such as by staples 47, which staples are disposed to engage the front wall 18 along a strip disposed directly below the openings 43. The securing of the flap 44 by the staples 47 results in the lower free end portion 48 of the flap being free of connection to the front wall so that same can be easily gripped when release of the flap is desired.

While the flap 44 in the illustrated embodiment is secured to the front wall 18 by staples 47, it will be appreciated that the staples 47 could be replaced by a strip of adhesive or other similar securing means extending across the flap and engaging the front wall 18 directly below the openings.

Figure 6:
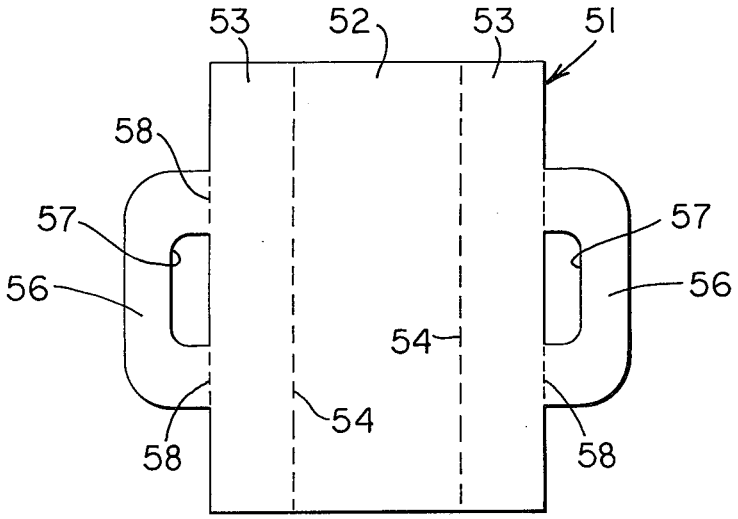
FIG. 6 is a plan view of the punched blank used for forming the handle.

Considering now the handle means 14, same is formed from a separate punched blank 51 (FIG. 6), which blank is also punched from a sheet of material, such as corrugated cardboard. The blank 51 includes a substantially rectangular center portion 52 which is of substantially the same dimensions as the rear wall 19. A pair of rectangular portions 53 are integrally connected to the opposite edges of the center portion 52 and are separated therefrom by fold line 54. The end portions 53 each have a width which is approximately one-half the width of the center portion 52. Each end portion 53 has a C-shaped loop or handle 56 integrally connected to the free edge thereof, which loop 56 defines a substantially closed finger opening 57. Loop 56 is joined to the edge of the end portion 53 at the fold line 58.

ASSEMBLY AND OPERATION

The assembly of the dispensing-type receptacle 10, and the utilization of same, will be briefly described to ensure a complete understanding thereof.

To manufacture and assemble the receptacle 10, the blanks 23 and 51 are initially formed, such as by being punched from a sheet of corrugated cardboard, which punching operation occurs in a conventional manner and results in the formation of the fold lines to permit hinging of the respective adjacent portions of the blank.

After formation of the blank 23, same is appropriately folded to form a substantially tubular configuration as defined by the walls 16–19, which tubular configuration is fixedly closed by adhesively securing the flap 26 to the inner surface of the sidewall 17 adjacent the free edge thereof. The flaps 33, 34, 38 and 41 are then folded inwardly to overlap the open upper and lower ends of the tubular portion, following which the flaps 29 and 31 are also folded inwardly to overlap and substantially close the upper and lower ends of the tubular sidewall portion. The top and bottom walls 21 and 22, respectively, are then also folded inwardly so as to overlap the flaps 29 and 31, respectively, thereby closing the box 11 and defining therein the closed compartment 12. The upper flaps 21 and 29 are suitably fixedly connected, as by staples 61, and the lower flaps 22 and 31 are also suitably fixedly connected by staples. However, other securing structures, such as an adhesive, could be used for connecting the upper and lower overlapping flaps.

Prior to the complete closing of the box 11, such as prior to the sealing of the upper flaps 21 and 29, the handle assembly 14 is positioned within the interior of the box. For this purpose, each C-shaped handle 56 is initially folded downwardly through an angle of approximately 90° relative to its respective end portion 53. The end portions 53 are then folded upwardly through an angle of approximately 180° so that the two end portions 53 overlap the center portion 52 and effectively form a double thickness of cardboard. This also results in the handle portions 56 being disposed directly adjacent one another in side-by-side relationship, which handle portions project outwardly at a substantially right angle relative to the center portion 52. The thus folded blank 51 is then inserted into the interior of the box 11, whereupon the adjacent handle portions 56 are inserted through the slot 37 and the folded blank is moved sidewardly so that the folded end portions 53 are positioned in engagement with the inner surface of the rear wall 19, which opposed engaging surfaces are preferably suitably secured together as by an adhesive. The compartment 12 is then suitably filled with the desired particulate material, whereupon the flaps 21 and 29 are suitably closed and fixedly secured together.

After closing of the top flaps as noted above, then the closing flap 44 is swung downwardly about the fold line 46 so that the flap overlies the upper portion of the front wall 18, and particularly overlies the plurality of openings 43. The flap 44 is then fixedly connected to the front wall 18, as by means of the staples 47, which staples connect the flap and the front wall along a strip disposed below the openings 43 but spaced upwardly from the lower free edge of the flap.

To facilitate the shipping and storing of a plurality of similar receptacles 10, the handles 56 can each be folded over in opposite directions so as to overlie the rear wall 19, as illustrated by dotted lines in FIG. 4, thereby permitting the receptacle 10 to assume the shape of a rectangular prism.

When it is desired to dispense material from the box 11, the handles 56 are folded outwardly into their gripping position as illustrated by solid lines in FIG. 4. The free edge 48 of flap 44 is also gripped and pulled outwardly away from the front wall 18, thereby releasing the flap 44 so that same can be swung upwardly into the position illustrated by dotted lines in FIG. 1, whereby the openings 43 are uncovered. By then gripping the overlying handles 56, the box can then be lifted and tilted as necessary to permit the material to be dispensed through the openings 43.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A dispensing-type receptacle, comprising:

wall means defining a substantially closed box having a substantially closed compartment in the interior thereof adapted for the storing of a particle material;

said wall means including (1) a pair of opposed and substantially parallel sidewalls, (2) opposed and substantially parallel front and rear walls extending between and connected to the edges of said sidewalls for defining a tubular member of substantially rectangular cross section, said rear wall having a vertically elongated slot formed centrally thereof, and (3) opposed and substantially parallel top and bottom walls extending between the upper and lower edges, respectively, of said tubular member for closing the upper and lower ends thereof;

dispensing means associated with said front wall for permitting the material within said compartment to be poured from said box, said dispensing means including a plurality of preformed openings within said front wall adjacent the upper end thereof, said openings being disposed within at least two horizontally extending rows which are spaced one above the other, each row containing therein a plurality of openings with the openings in one row being horizontally staggered relative to the openings in the other row;

said dispensing means also including a closing flap fixedly but releasably coupled to said front wall for overlying said openings, said closing flap being integrally connected to said top wall and separated therefrom by a fold line which permits said flap to be folded downwardly to overlie the upper portion of said front wall, and securing means for securing said flap to said front wall at a location disposed below said openings, said securing means being spaced upwardly from the lower free edge of said flap so that the lower edge portion of said flap is free of connection to said front wall; and handle means associated with said rear wall for permitting gripping of said receptacle, said handle means comprising a separate sheetlike member positioned within the interior of said box and disposed so as to overlie said rear wall, said sheetlike member having a center portion of rectangular size substantially similar to said rear wall, said sheetlike member also having a pair of rectangular end portions integrally connected to the opposite ends of said center portion, said end portions having a width substantially one-half the width of said center portion and being hingedly connected to said center portion so that said end portions are folded inwardly to overlap said center portion to form a double thickness;

said handle means further including a substantially C-shaped loop integrally but hingedly connected to the free edge of each of said end portions and extending substantially perpendicular thereto whereby the C-shaped loops as connected to said end portions are disposed directly adjacent one another in side-by-side relationship and form a C-shaped handle which projects outwardly through said slot so as to be accessible from the exterior of said box, each of said C-shaped loops being foldable downwardly away from one another so as to overlie the exterior surface of said rear wall in substantially parallel relationship therewith, and said end portions of said sheetlike member being abuttingly engaged with and fixedly secured to the inner surface of said rear wall.

* * * * *